US011146880B2

(12) United States Patent
Sandanger et al.

(10) Patent No.: US 11,146,880 B2
(45) Date of Patent: Oct. 12, 2021

(54) SKIRT ATTACHMENT

(71) Applicant: SECTIO AUREA AS, Oslo (NO)

(72) Inventors: Vidar Sandanger, Oslo (NO); Johan Sundkvist, Oslo (NO); Henrik Myhre-Sandmark, Oslo (NO)

(73) Assignee: SECTIO AUREA AS, Oslo (NO)

( * ) Notice: Subject to any disclaimer, the term of this patent is extended or adjusted under 35 U.S.C. 154(b) by 0 days.

(21) Appl. No.: 17/029,002

(22) Filed: Sep. 22, 2020

(65) Prior Publication Data

US 2021/0006887 A1 Jan. 7, 2021

Related U.S. Application Data

(63) Continuation of application No. 16/392,597, filed on Apr. 23, 2019, now Pat. No. 10,820,085.

(51) Int. Cl.
*H04R 1/10* (2006.01)
*H04R 25/00* (2006.01)

(52) U.S. Cl.
CPC ..... *H04R 1/1016* (2013.01); *H04R 1/105* (2013.01); *H04R 25/652* (2013.01)

(58) Field of Classification Search
CPC ..... H04R 1/1016; H04R 1/10; H04R 1/105; H04R 25/652; H04R 25/604; H04R 2460/17
See application file for complete search history.

(56) References Cited

U.S. PATENT DOCUMENTS 3,935,401 A 1/1976 Shore et al.
4,965,838 A 10/1990 Kamon
7,986,803 B1 7/2011 Dekalb
8,731,228 B2 * 5/2014 Burgett ..... H04R 1/1016 381/380
2005/0008180 A1 1/2005 Smith et al.
2009/0285436 A1 11/2009 Lowry
2010/0027824 A1 * 2/2010 Atamaniuk ..... H04R 1/105 381/322
2010/0278364 A1 11/2010 Berg
2014/0037123 A1 2/2014 Keong et al.
(Continued)

FOREIGN PATENT DOCUMENTS

EP 2192789 A2 6/2010
EP 2878135 B1 10/2017
(Continued)

OTHER PUBLICATIONS

EPO Communication in corresponding European Application No. 19 170 641.5, dated Feb. 16, 2021.
(Continued)

*Primary Examiner* — Sunita Joshi
(74) *Attorney, Agent, or Firm* — Hershkovitz & Associates, PLLC; Abe Hershkovitz

(57) ABSTRACT

Auricular attachments should be comfortable for long term wear.

An auricular interface based on a skirt attachment is disclosed. By separating the uplifting force of the skirt from a separate downward force a more comfortable wearing is achieved. The skirt can optionally be pleated.

The objective is achieved by a skirt structure having an outer surface that contacts least a part of an inner part of an outer boundary of a concha of a pinna, without the skirt touching the floor of the concha.

20 Claims, 10 Drawing Sheets

(56) References Cited

U.S. PATENT DOCUMENTS

| | | | | |
|---|---|---|---|---|
| 2014/0105431 | A1 | 4/2014 | Berg | |
| 2014/0286515 | A1* | 9/2014 | Bone | H04R 1/1016 381/328 |
| 2015/0215693 | A1 | 7/2015 | Sandanger | |
| 2015/0281819 | A1 | 10/2015 | Silvestri et al. | |
| 2015/0281822 | A1 | 10/2015 | Berg | |
| 2015/0312665 | A1 | 10/2015 | Berg | |
| 2016/0205456 | A1 | 7/2016 | Berg | |
| 2018/0035192 | A1 | 2/2018 | Houle | |
| 2018/0167713 | A1 | 6/2018 | Chou et al. | |
| 2018/0213315 | A1 | 7/2018 | Kirkpatrick | |
| 2018/0332380 | A1 | 11/2018 | Berg | |
| 2019/0029593 | A1 | 1/2019 | Orron et al. | |
| 2019/0110117 | A1 | 4/2019 | Kirkpatrick | |
| 2019/0200112 | A1 | 6/2019 | Briggs et al. | |

FOREIGN PATENT DOCUMENTS

| | | | |
|---|---|---|---|
| GB | 2220819 | A | 1/1990 |
| WO | WO 2002/045390 | A1 | 6/2002 |
| WO | WO 2004/068896 | A2 | 8/2004 |
| WO | WO 2008/147215 | A1 | 12/2008 |
| WO | WO 2009/143055 | A1 | 11/2009 |
| WO | WO 2010/127265 | A2 | 11/2010 |
| WO | WO 2017/183027 | A1 | 10/2017 |
| WO | WO 2018/058879 | A1 | 4/2018 |

OTHER PUBLICATIONS http://phonearena.com/reviews/Samsung-Gear-IconX-2018-Wireless-Headphones-Bluetooth-Review_id4445.

http://phonearena.com/reviews/Sony-WF-1000X-wireless-headphones-Review_id4465.

http://phonearena.com/reviews/Jaybird-Run-wireless-headphones-Review_id4455.

International Search Report in corresponding International Application No. PCT/EP2019/087158, dated Jan. 28, 2020.

Written Opinion of the International Searching Authority in corresponding International Application No. PCT/EP2019/087158, dated Jan. 28, 2020.

European Search Report in related Application No. EP 19170641.5, dated Jun. 26, 2019.

Search Report in related Application No. GB 1905656.3, dated Jul. 11, 2019.

Norwegian Search Report in related Application No. NO 20190532, dated Aug. 23, 2019.

Official Communication in corresponding European Application No. 19 170 641.5, dated Jul. 27, 2020.

Official Communication in corresponding European Application No. 19 829 247.6, dated Oct. 13, 2020.

* cited by examiner

Fig.10A1
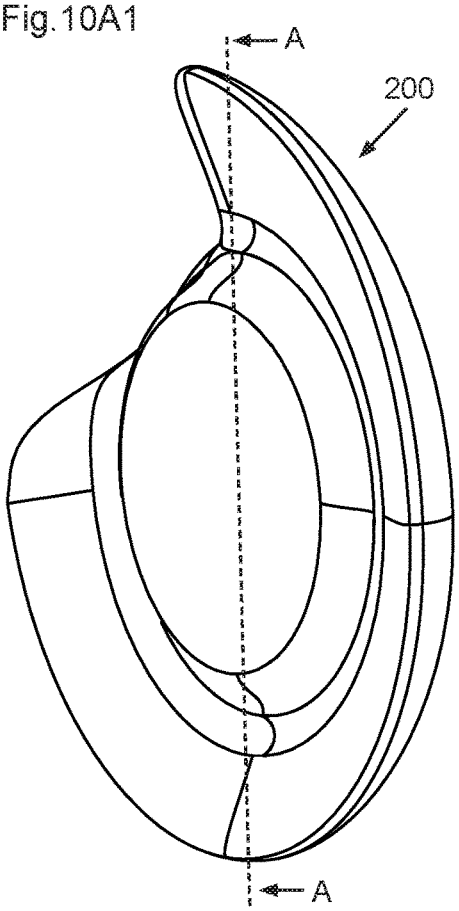
Fig.10A2
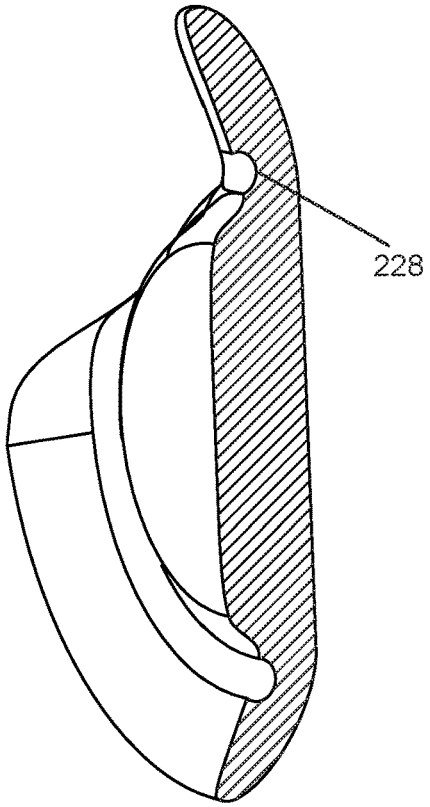
Fig.10B
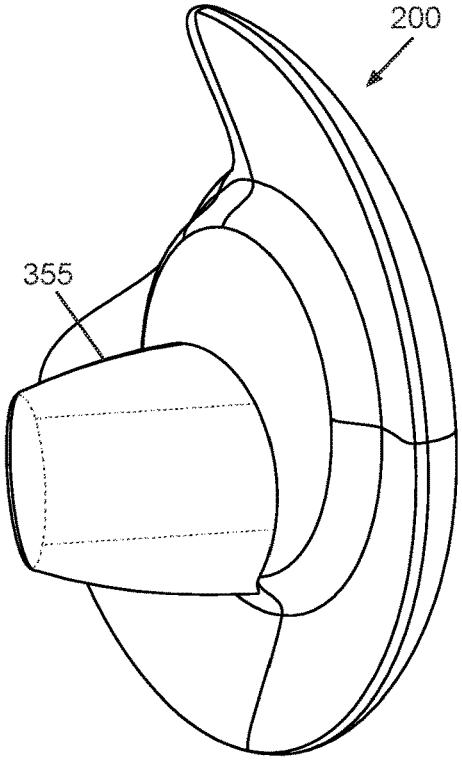
Fig.10C
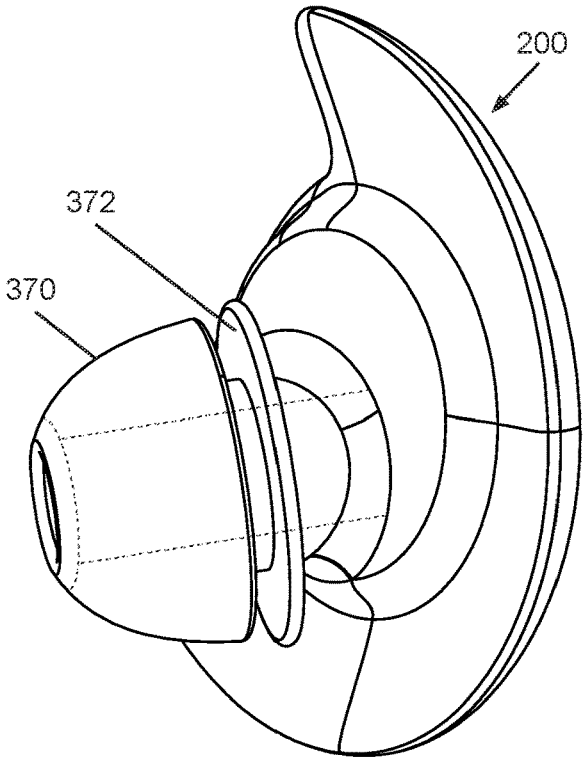

SKIRT ATTACHMENT

CROSS-REFERENCE TO RELATED APPLICATION

This patent application is a non-provisional continuation application, which claims the benefits of and is based on U.S. application Ser. No. 16/392,597 filed on Apr. 23, 2019, the disclosure of which is hereby incorporated by specific reference thereto.

BACKGROUND OF THE INVENTION

Field of the Invention

The invention relates to auricular structures in general and more specifically an attachment structure for fitting devices to the human auricle.

Background Art

Numerous attachment means are known for auricular attachment such as on-ear and in-ear solutions.

One solution is known as the "in-ear" solution, wherein the sound emitting device, also known as a hearing element, enters the ear canal. Typically a housing unit comprising a hearing element is positioned inside the concha and within the tragus and anti tragus, while a funnel ducts the sound into the ear canal. Frequently the funnel is provided with a gasket having flanges to dampen ambient sounds. Typically such devices use the ear canal for attachment. While the solution is compact, removes ambient sound efficiently and also allows for good audio fidelity it suffers from the disadvantage of being uncomfortable due to pressure exerted on the pressure sensitive ear canal.

Another solution is the "on ear" solution, wherein the hearing element is held against the ear having a concha. This geometry allows for a wide hearing element to be placed flat against the concha. Unlike the in ear solution, this solution requires a separate means for holding the hearing element in position over the concha and several such means are well known in the art, such as over-head attachment, headband and over-ear attachment. This solution is simple but suffers from long term discomfort due to pressure exerted on the ear by the means for holding. There can also be problems with ambient sound entering the ear unless a sound absorbing cushion is used that encloses the ears fully bringing in other disadvantages such as large size.

A third solution is the "ear bud" solution where a housing unit comprising a hearing element is positioned inside the concha and held in place by tragus and anti tragus. In this way the housing unit also forms the means for holding the hearing element in place. While compact the disadvantage is discomfort due to pressure exerted on the tragus and anti tragus and also that it is difficult to exclude ambient sounds. If the pressure against the tragus and anti tragus is reduced the ear bud then is rather loose and can easily fall out.

A fourth solution is disclosed in WO120021045390 relating to an earpiece having a C-shape, and WO120081147215 relating to an improved earpiece having a curve and a curvature. Both disclose comfortable means for stable attachment to an anti helix of an ear. The former discloses an open solution that allows the auditory canal to remain open to the surroundings to a certain degree, which provides better comfort than a unit that blocks or closes off the auditory canal. This provides air circulation at the expense of admitting ambient sounds.

This solution works by contacting or engaging the inner surface of the concha under the antihelix. This results in stability in the XY-plane or the sagittal plane. The disadvantage is that while these fit practically all ears, this can lead rather tight fit, especially when supporting a large housing which substantially fills the concha. A good fit to the inner surface of the concha, which is the floor of the concha, is also important.

For the fifth solution one should refer to in-ear speakers as disclosed in WO120091143055 where a hearing element is placed into the concha and facing the tragus, perpendicular to that of the on-ear solution. The problem is stable positioning of the hearing element and discomfort relating to the edge of the hearing element is pressed against the inner wall of the concha when positioned in the ear.

There is therefore a need for a method and a system to overcome the above mentioned problems.

SUMMARY OF THE INVENTION

Problems to be Solved by the Invention

Therefore, a main objective of the present invention is to provide a simple and versatile auricular interface that is stable, secure and comfortable.

Means for Solving the Problems

The objective is achieved according to the invention by an apparatus for auricular attachment as defined in the claims, having the features of the characterising portion as recited in the claims.

A number of non-exhaustive embodiments, variants or alternatives of the invention are defined by the claims.

The present invention attains the above-described objective by a skirt structure having an outer surface that contacts least a part of an inner part of an outer boundary of a concha of a pinna, without the skirt touching the floor of the concha.

In a first aspect of the invention an auricular interface is disclosed, comprising a skirt, comprising an outer surface further comprising an outer surface contact area for engaging at least a part of an inner part of an outer boundary of a concha of a pinna, an inner surface opposite of the outer surface, and an outer skirt edge, and a counter pressure member for contacting parts of the pinna to counter a force caused by the skirt, wherein the skirt does not contact a floor of the pinna, when the auricular structure is inserted into an ear.

In a preferred embodiment the outer boundary is at least one from the group comprising antihelix, tragus, antitragus, and crus of helix.

In a preferred embodiment the skirt is pleated.

In a preferred embodiment, the auricular interface further comprising a frame for attaching a housing to the auricular interface.

In a preferred embodiment the counter pressure member for contacting parts of the pinna to counter a force caused by the skirt, is at least one counter pressure member from the group comprising a counter pressure member for engaging a concha wall contact area, a counter pressure member for engaging a crus of helix contact area, a counter pressure member for engaging a cymba concha contact area, and a counter pressure member for engaging a cavum concha contact area of the pinna.

In a more preferred embodiment the counter pressure member for contacting the to counter a force caused by the skirt, extends from the frame In a further preferred embodiment the frame comprises a frame body surrounding a central frame body opening.

In a preferred embodiment the frame comprises a frame skirt interface connecting the skirt to the frame, wherein the frame skirt interface provides added flexibility to the skirt by at least one from the group comprising a joint and a constricted part.

In a preferred embodiment the skirt has a concave form.

In another preferred embodiment the skirt has a convex form.

In a preferred embodiment the counter pressure member engages part of the pinna outside the concha.

In a preferred embodiment the counter pressure member is a collar, wherein the collar contacts the outer part of the antihelix along an outer antihelix contact area, providing a counteracting force to the force from the skirt.

In a preferred embodiment the counter pressure member is a slot, wherein an outer part of the slot contacts the outer part of the antihelix along an outer antihelix contact area, providing a counteracting force to the force from the skirt.

In a more preferred embodiment the skirt is part of the lower part of the slot and continues to an upper part of the slot.

In a preferred embodiment the skirt and frame have an unitary structure.

In a preferred embodiment the housing is provided with a counter pressure member for engaging at least parts of the concha.

Effects of the Invention

The present invention comprises a technological advantage over known systems and methods by use of a skirt attachment that does not contact the concha floor. This allows a far greater freedom of design.

The present invention provides several further advantageous effects:

it allows for balancing the pressure against the ear canal or the opening to the ear canal with the pressure against the concha wall, permitting a more comfortable fit than traditional in-ear devices while maintaining proper sealing, it allows for an even pressure against the ear canal or the opening to the ear canal, which is important when uses with noise cancelling, it makes it possible to provide attachment with a smaller device compared to known devices, it simplifies fittings to an ear without taking concha floor geometries into account.

it makes it possible to fit larger and heavier housings into the concha with larger capacity for advanced electronics and sensors, without obstructions from the auricular interface and while remaining comfortable, and it provides a comfortable solution when using larger housings.

BRIEF DESCRIPTION OF THE DRAWINGS

The above and further features of the invention are set forth with particularity in the appended claims and together with advantages thereof will become clearer from consideration of the following detailed description of an [exemplary] embodiment of the invention given with reference to the accompanying drawings.

The invention will be further described below in connection with exemplary embodiments which are schematically shown in the drawings, wherein:

FIGS. 10A1 and 10A2 show an unitary ear unit having a skirt and body without a frame, FIGS. 10B and 10C show an unitary ear unit having a skirt and body with audio ducts and without a frame.

DESCRIPTION OF THE REFERENCE SIGNS

Figure 1B:
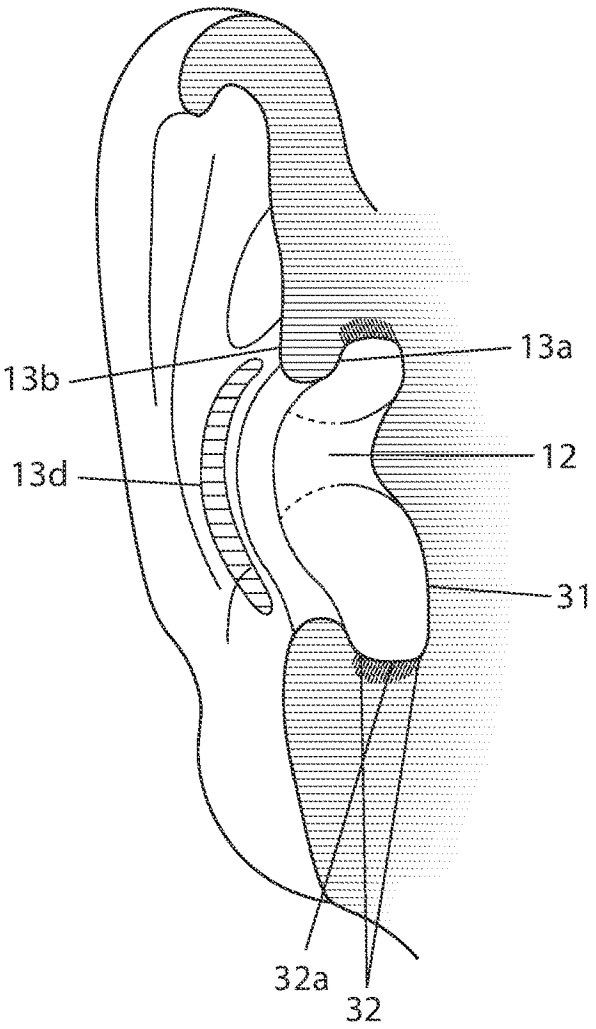
FIG. 1B shows a cross section the anatomy of a human ear along A-A.

The following reference numbers and signs refer to the drawings:

10 Pinna
11 Helix
11*a* Flap
12 Crus of helix
12*a* Extension of crus of helix
12*b* Crus of helix contact area
13 Antihelix
13*a* Inner part of antihelix
13*b* Outer part of antihelix
13*c* Inner part of antihelix contact area
13*d* Outer part of antihelix contact area
14 Crura of antihelix
15 Superior crux
16 Inferior crux
17 Fossa triangularis

18 Sulcus auriculae posterior
21 Tragus
22 Antitragus
23 Incisura intertragica, intertragic notch
24 Concha
25 Cymba concha
25*a* Cymba concha contact area
26 Cavum concha
26*a* Cavum concha contact area
27 Scapha
28 Sub tragus region
30 Ear canal
31 Concha floor
32 Concha wall
32*a* Concha wall contact area
100 Ear unit
200 Anchor, skirt
210 Curve, outer skirt edge
212 Upper end
213 Protrusion
214 Lower end
216 Extended lower end
222 Skirt outer surface
224 Skirt contact surface
226 Skirt inner surface
228 Hinge
232 Incision
234 Tongue
250 Frame
252 Frame body
254 Frame opening
256 Frame skirt interface
272 Collar
280 Slot
282 Slot outer part
300 Housing
306 Housing frame interface
350 Hearing element
352 Hearing element opening
354 Audio duct
355 Audio duct nozzle
356 Audio duct opening
358 Audio duct joint
360 Electroacoustic element
370 Gasket, eartip
372 Flanges
400 Part extending downwards
500 Counter pressure members
502 Counter pressure member for engaging concha wall
504 Counter pressure member for engaging crus of helix
506 Counter pressure member for engaging cymba concha
508 Counter pressure member for engaging cavum concha

DETAILED DESCRIPTION OF THE INVENTION

Anatomy of the Human Ear

Figure 1A:
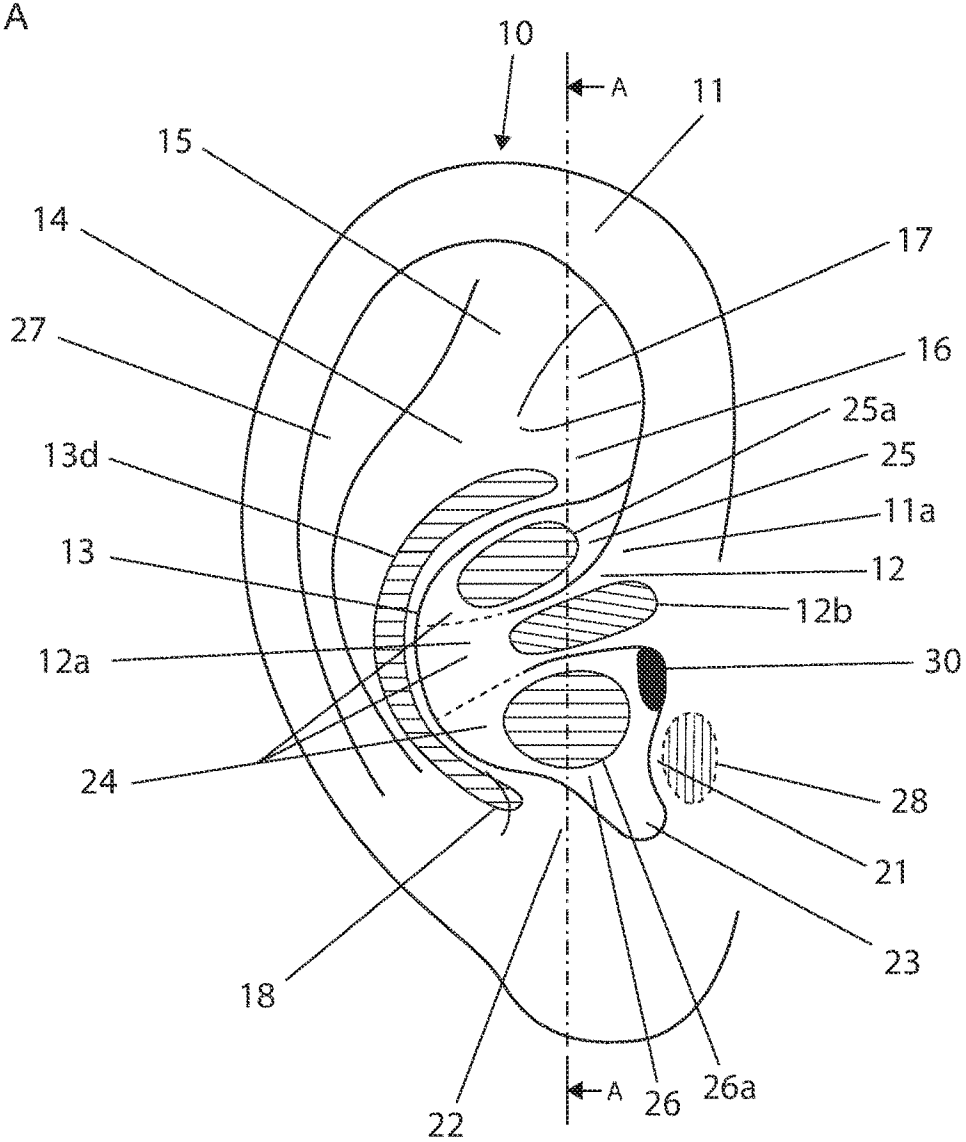
FIG. 1A shows the anatomy of a human ear from the outside.

Referring to FIG. 1A, the structure of a human ear, and in particular of the outer ear, is depicted. Various features of the outer ear as described herein are closely related to the various embodiments of the ear-mounted apparatus according to this disclosure.

Specifically, outer ear 10, also known as pinna or auricle, comprises a plurality of features of significance. Outermost is helix 11, a fold of cartilage, tracing the periphery of the ear upwards and in towards the skull where it transitions into crus of helix 12. Within this is antihelix 13 which in the upward direction bifurcates into crura of antihelix 14, comprising superior crux 15 and inferior crux 16, separated by fossa triangularis 17. Below the antihelix is sulcus auriculae posterior 18 and further below that again is antitragus 22 which is opposite tragus 21, separated by incisura intertragica 23, also known as the intertragic notch. Within these again is concha 24 which comprises cymba concha 25 and cavum concha 26, separated by crus of helix 12.

It should be noted that a the part of helix near where it transitions into crus of helix forms a flap 11*a* that covers the anterior part of fossa triangularis and the anterior part of the upper part of the antihelix. The crus of helix extends about halfway across the concha, after which it transitions into an extension of the crus of helix 12*a* extending as a ridge to the posterior of the concha under the antihelix.

Immediately within and partially covered by the tragus is the entrance to the ear canal 30. It is important to realize that this entrance is still a part of cavum concha. The ear canal proper extends from the deepest part of the concha to the eardrum, a distance of about 2.5 cm and approximately 4 cm from the tragus. The ear canal comprises an approximately 8 mm lateral cartilaginous part and an approximately 16 mm medial osseous part. It should also be noted that it is typically quite uncomfortable to have any foreign object in the ear canal. The ear canal is partially visible from the outside and is indicated in FIG. 1A.

This area immediately within and partially covered by the tragus 21 does not have an official anatomical name. For the purposes of this disclosure it has been called the sub-tragus region 28. The ear canal 30 is located below the sub-tragus region.

Referring to FIG. 1B, the bottom of the concha is seen from the side along the crus of helix 12. The bottom of the concha appears as a floor of the concha cavity enclosed by the concha wall rising up from the floor to the antihelix. The antihelix 13 forms a roof like structure or overhang that typically covers the wall of the concha, the antihelix having an inner part 13*a* that faces the floor, curving around to an outer part 13*b* that faces away from the floor. Similarly also the tragus and the antitragus comprise such inner and outer parts. The wall is elastic and will expand and become wider if an outward pressure is applied. The floor is above the skull bone and follows the skull bone and thus provide limited flexibility, while the wall is not constrained by the skull bone in the same way, permitting more flexibility.

The antihelix, tragus, antitragus and crus of helix represent an outer boundary of the concha surrounding the concha, rising above the concha floor.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

Stability of Ear-Mounted Apparatus

A movable object in space can be described with 6 degrees of freedom: linear: anterior—posterior, dorsal—ventral, and left—right lateral; rotational: in the sagittal plane, in the coronal plane, and in the transverse plane.

For an ear mounted or head mounted device these axes and planes are defined with reference to the head according to anatomical terms of location. For a device to be stably positioned into an ear it is important that linear motion is restricted relative to the ear, otherwise the device will fall out. Similarly it is strongly preferred that rotational motion relative to the head is restricted. For use for optical devices flash light, display unit such as VR devices or camera such stability is important for the user experience. Also a rapid rotational movement of the head can create a force that pulls the device out of the ear.

For a device having a member extending forward this means that a static rotational force in the sagittal plane is created as gravity pulls the member downwards. This then must be counteracted by a rotational stabiliser.

In this context, "sagittal plane" is a modified parasagittal plane that passes through the concha and roughly intersects the antihelix cartilage. The Z-axis is perpendicular to this plane.

In the following audio duct means a device that carries sound, while a nozzle is an audio duct that is seen from the outside and carries sound towards the ear canal, typically into the ear canal or the opening of the ear canal.

Principles Forming the Basis of the Invention

The underlying principle of the invention is the understanding that a skirt like structure positioned in a concha wherein the skirt fits along the inner surface of an outer boundary of the concha without touching the concha floor, will be pushed towards the centre of the concha in a direction substantially normal to the sagittal plane. Stability is achieved by applying a counter force by separate means for contacting parts of the pinna.

Figure 2B:
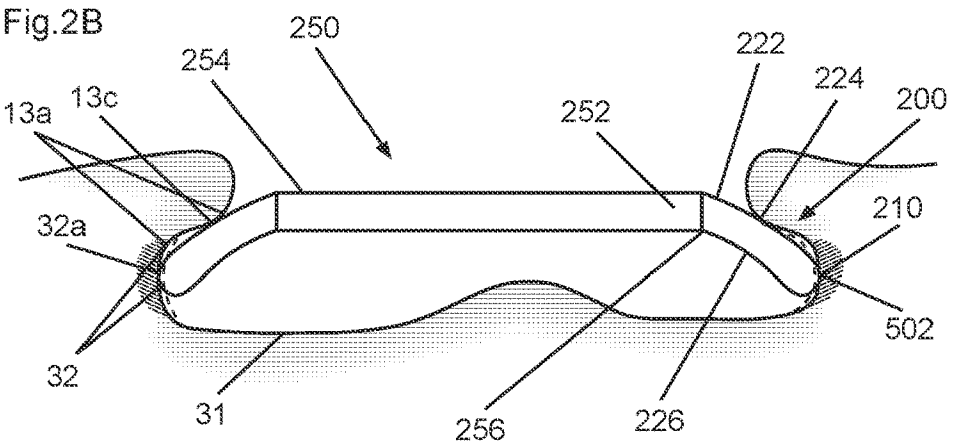
FIG. 2B shows the skirt structure of FIG. 2A inserted into an ear.
Figure 2C:
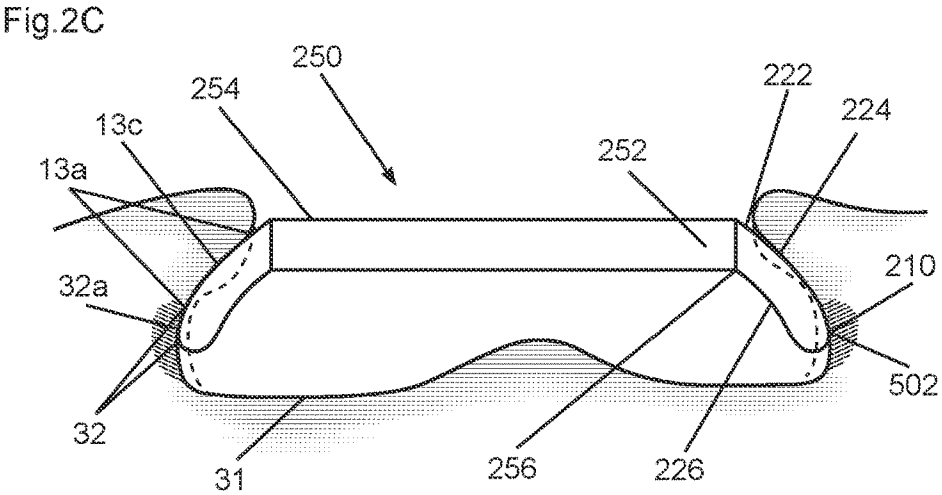
FIG. 2C shows the skirt structure of FIG. 2A inserted into a smaller ear.
Figure 2A:
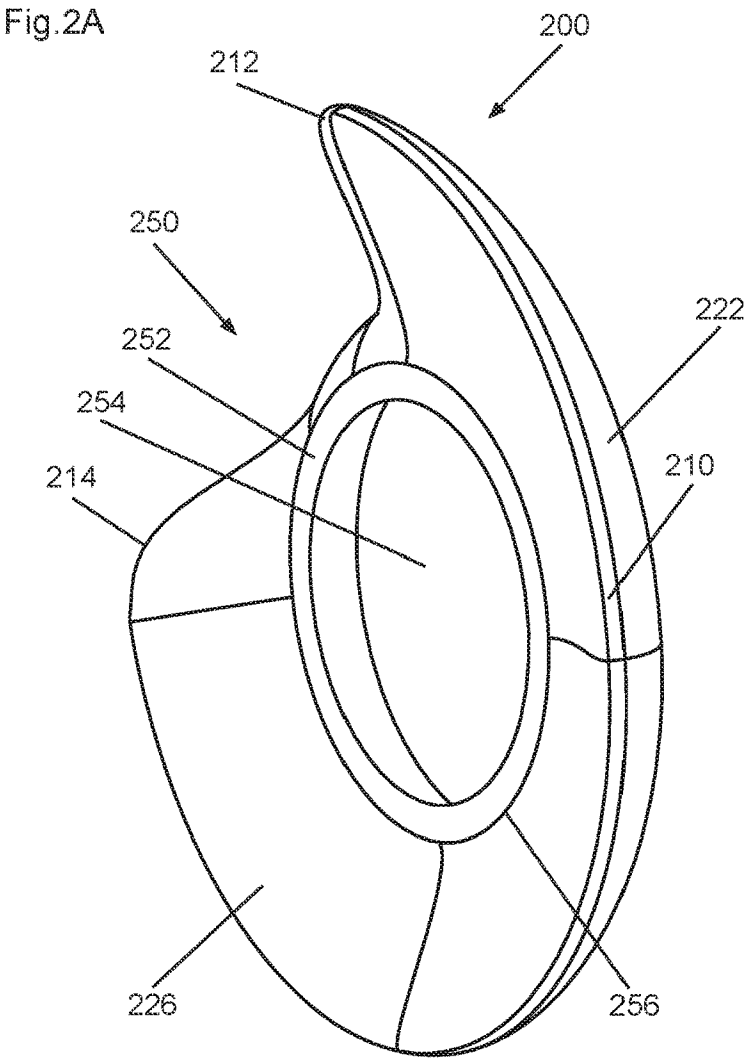
FIG. 2A shows an umbrella skirt structure in a relaxed state.

FIG. 2A shows an umbrella skirt structure 200 in a relaxed state. The skirt 200 comprises an outer surface 222 comprising an outer surface contact area 224 for engaging the inner part 13*a* of the antihelix, an inner surface 226 opposite of the outer surface 222, and a skirt edge 210.

In this embodiment the skirt has a concave form where the outer surface of the skirt contacts the inner surface 13*a* of the antihelix along a contact surface 13*c* and thus creates a force towards the concha. This is balanced by a force in the opposite direction set up by the edge 210 of the skirt pressing against the wall of the concha. This pressure makes the concha wall expand somewhat and at the widest position provide room for contact between the edge 210 of the skirt and the concha wall. It should be noted that the contact area 32*a* along the wall 32 is above the concha floor 31 and thus the skirt does not contact the concha floor for stability.

Some form of flexibility is required for this effect. In one group of embodiments the flexibility is that of the cartilage of the ear, typically that of the antihelix. The outer ear is made of elastic cartilage that allows for the antihelix to flex in-plane making it wider, or allow the antihelix to flex out of plane whereby the antihelix overhang is pulled up or down.

In a second group of embodiments the skirt itself can be made to flex. In one subgroup of embodiments the skirt comprises a slot defining two ends of the skirt, allowing the two ends of the skirt facing the slot to be pressed together, closing the slot, permitting the skirt to be inserted into the concha. In a second subgroup of embodiments the skirt itself can be deformed so that it flares out less then in a relaxed state, again permitting the skirt to be inserted into the concha.

By use of the above described flexibility the skirt like structure is inserted into the concha. On relaxing the skirt, the skirt expands and locks into the concha of the ear by contacting the inner surface of the antihelix without touching the concha floor. The gentle residual pressure ensures the skirt is securely fitted in the Z-axis and thus finds stability in the sagittal plane. Some rotational stability is assured by friction. This can be further improved by keying features engaging anatomical features such as the intertragic notch.

FIG. 2B shows the skirt of FIG. 2A inserted into an ear, where the skirt 200 presses against the inner part 13*a* of the antihelix along a contact surface 13*c*.

FIG. 2C shows the skirt structure of FIG. 2A inserted into a smaller ear. As the figure shows the same skirt fits into the smaller ear by pressing the skirt closer together.

It is not important for the functioning to contact the features of the inner surface of the concha, the concha floor 31. Instead the skirt can engage the antihelix with a rim, adding rotational stability and also defining the depth to which the skirt enters the concha volume. Thus the skirt floats above the inner surface of the concha.

BEST MODES OF CARRYING OUT THE INVENTION

Skirt Embodiments

The embodiments of the apparatus according to the invention shown in FIGS. 2A, 2B, 2C, 2D, and 2E comprise skirts engaging the concha wall to provide counter pressure.

Figure 2D:
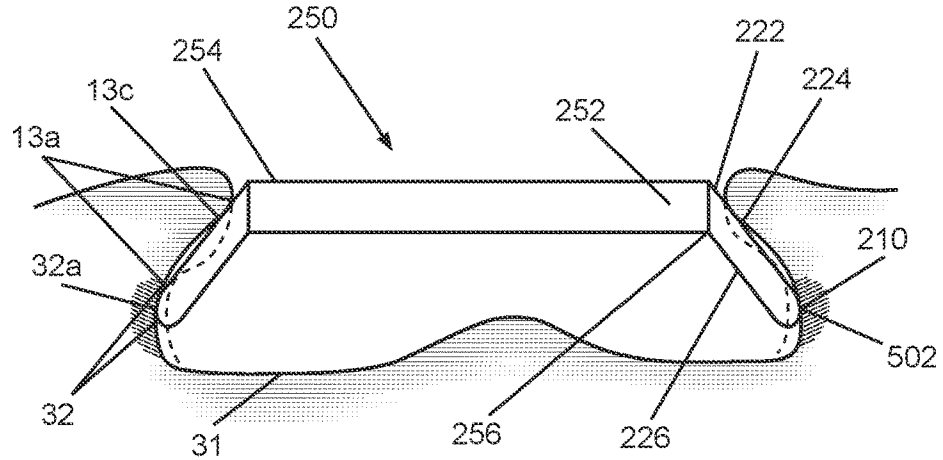
FIG. 2D shows a simple conically shaped skirt structure inserted into an ear.

FIG. 2D shows a simple conically shaped skirt structure inserted into an ear. In this embodiment the skirt has a conical form where the outer surface of the skirt contacts the inner surface 13*a* of the antihelix along a contact surface and thus creates a force towards the concha. This is balanced by a force in the opposite direction set up by the edge 210 of the skirt pressing against the wall of the concha. This pressure makes the concha wall expand somewhat and at the widest position provide room for contact between the edge 210 of the skirt and the concha wall. It should be noted that the contact area 32*a* along the wall 32 is above the concha floor 31 and thus the skirt does not contact the concha floor for stability.

Figure 2E:
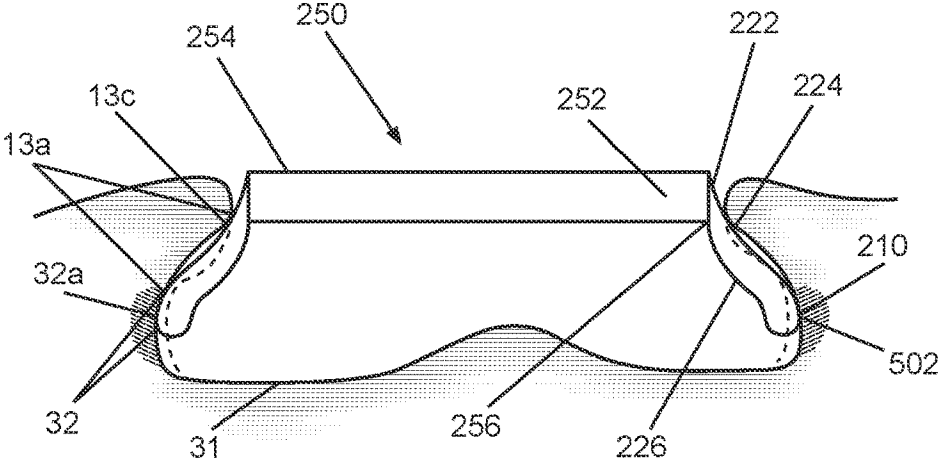
FIG. 2E shows a trumpet shaped skirt structure inserted into an ear.

FIG. 2E shows a trumpet shaped skirt structure inserted into an ear. The effect is similar to that shown in FIG. 2C with some minor differences. First of all the skirt in this embodiment has a convex form where the outer surface of the skirt contacts the inner surface of the antihelix along a contact surface and thus creates a force towards the concha. This contact area is typically further away from the concha wall and is also a thinner contact area. This is balanced by a force in the opposite direction set up by the edge 210 of the skirt pressing against the wall of the concha. This pressure makes the concha wall expand somewhat and at the widest position provide room for contact between the edge of the skirt and the concha wall. It should be noted that the contact area along the wall is above the concha floor and thus the skirt does not contact the concha floor for stability. Since the form is convex it is easier to apply a stronger force against the concha wall without being limited by the antihelix. Given sufficiently strong force the edge of the skirt will be sufficiently constrained by the concha wall expansion so that it is stable without relying on the antihelix.

In comparing the geometry of the skirt embodiments above the main difference is how the skirt contacts and acts on the antihelix. An umbrella structure contacts the inner surface of the antihelix close to the wall of the concha and the contact areas against the wall and the antihelix are close together and can merge. In this geometry the antihelix is raised by the counter pressure only to a small or insignificant degree.

In contrast a trumpet structure contacts the inner surface of the antihelix distal from the wall of the concha and the contact areas against the wall and the antihelix are far apart and are unlikely to merge.

For optimum effect the hardness of the material of the skirt should exceed that of the concha wall. That will ensure sufficient extension of the concha wall in order to provide the counteracting force to achieve stability. Thus also a hard inflexible material will work.

For interfacing to a payload the skirt in FIGS. 2C, 2D and 2E is attached to a frame 250 having a frame body 252 surrounding a central frame body opening 254. The attachment is via a frame skirt interface 256 that optionally provides flexibility by a joint or a constricted part. The frame interfaces to a payload such as a housing 300 having audio equipment for music, cell phone connectivity and the like. While the frame body opening 254 is shown as being circular, it is clear that it can be more flexible in shape and also be a semi circle, elongated, rectangular and more.

The frame is attached to the housing 300 at the housing frame interface 306. This interface is typically at the end of the housing proximal to the concha when positioned into the ear. It is also possible to have the interface 306 at a distal end of the housing, for instance for a convex embodiment of the skirt or if it is desirable that the ear unit extends as little outside the concha as possible. The frame thus makes it possible to contact either end of the housing.

The housing is detachably attached to the frame so that customers can select the most comfortable or secure skirt to the product in the housing.

The frame is preferably made of a material that is strong enough to handle multiple attachments and detachments. It can be made of a hard material. A resilient material can also be used for certain types of detachable attachments.

Counter Pressure Embodiment

Figure 3:
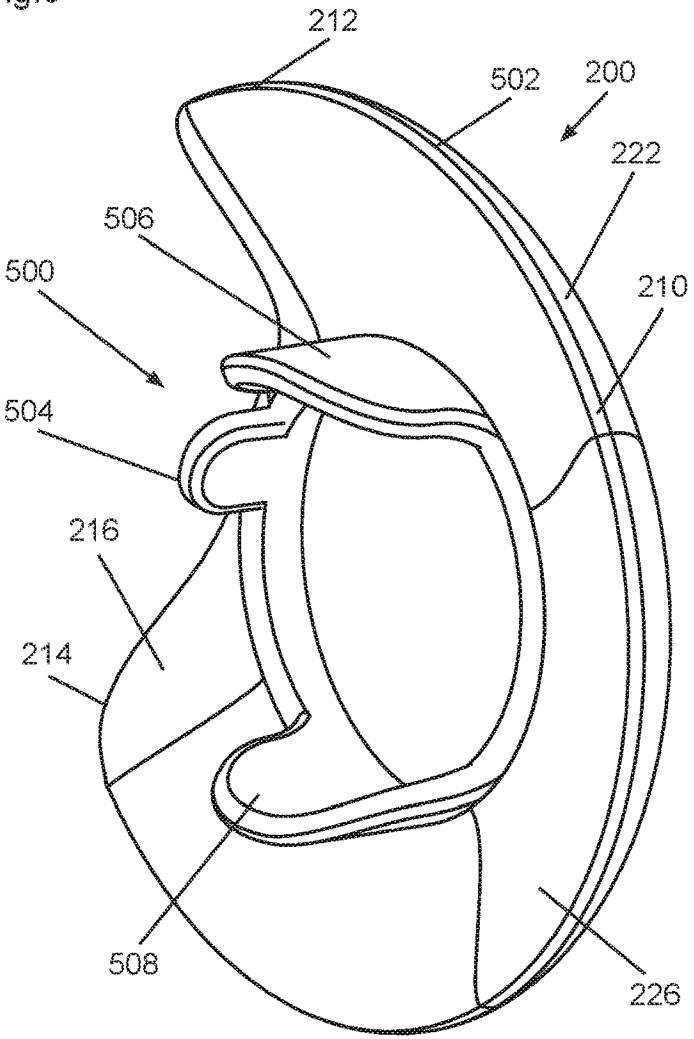
FIG. 3 shows an ear unit having a skirt and counter pressure members.

FIG. 3 shows an embodiment of the invention comprising a skirt and examples of a plurality of counter pressure members. The inward force is created by the skirt contacting the inner surface of the antihelix. The counter pressure members extends from the frame.

A counter balancing outward force is created by at least one counter pressure member 500. The counter pressure member is preferably a part 504 extending from the frame 250 to a contact area 12*b* of the crus of helix. There are further alternatives:

counter pressure member 502 for engaging concha wall contact area 32*a* counter pressure member 504 for engaging crus of helix contact area 12*b* counter pressure member 506 for engaging cymba concha contact area 25*a* counter pressure member 508 for engaging cavum concha contact area 26*a*

All of these can be used alone or combined freely. Also other counter pressure members can be used as long as they create a force countering that arising from the skirt.

Typically the counter pressure member 504 for engaging crus of helix contact area 12*b* will be short and in some embodiments a region on the frame without a protrusion will be sufficient.

Typically the skirt is a continuous body having an upper end 212 for fitting under a superior part of antihelix, typically under the inferior crux 16 of antihelix, and may optionally extend under a flap 11*a*. Typically the skirt also comprises a lower end 214 for fitting under an inferior part of antihelix, and may optionally comprise an extended lower end 216 for fitting under the antitragus or extend to under the tragus.

Payloads

Typically the frame is the contacting interface between the skirt and a payload such as audio equipment. By this separation of function it is possible to provide each customer with a device and a selection of skirts for the most comfortable fit while adapting to the use. When used in exercising a tighter fit can be desired.

Figure 6A:
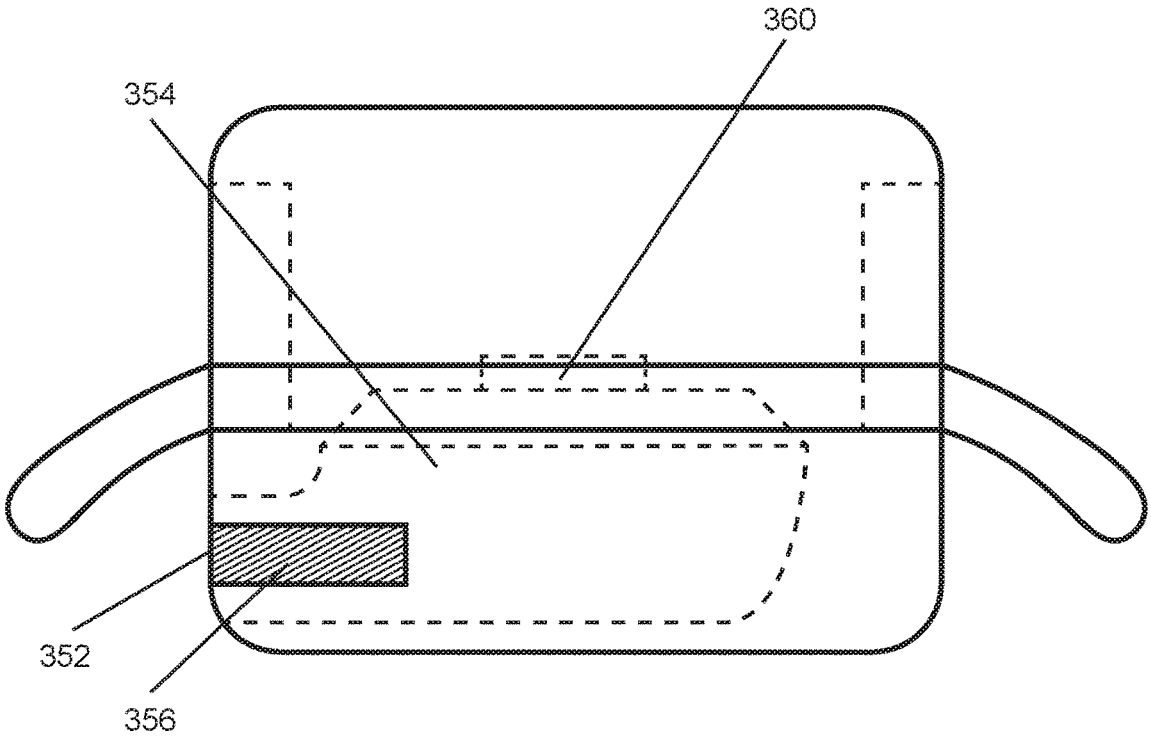
FIGS. 6A and 6B show an ear unit having an adjustable housing for sideways audio projection, in two different positions.
Figure 6B:
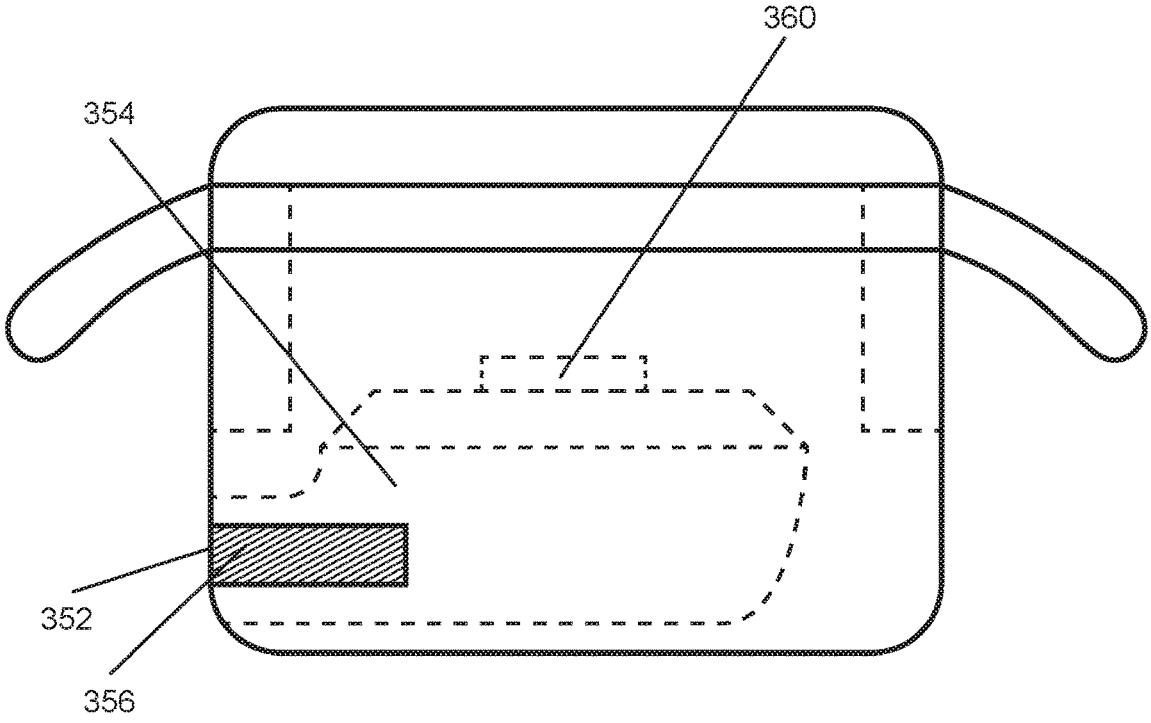

FIGS. 6A and 6B show an ear unit having an adjustable housing for sideways audio projection. FIG. 6A shows the housing in an upper position, where the lower end is retracted. The housing is provided with a sliding attachment to the frame so that it can be raised and lowered, preferably also rotated. In use the housing is held in place by friction or by a locking mechanism. FIG. 6B shows the housing in a lower position where the lower end enters and possibly touches the concha floor.

The housing comprises an electroacoustic element 360 in a cavity connecting the electroacoustic element with an opening 352 provided at a side of the housing via an audio duct 354, projecting the sound more directly towards the opening of the ear canal than for the embodiments where the sound is emitted towards the concha wall.

In use the user inserts the ear unit into the ear, lowers and rotates housing until the acoustic user experience is optimal.

Figures 7C, 7D, 7E:
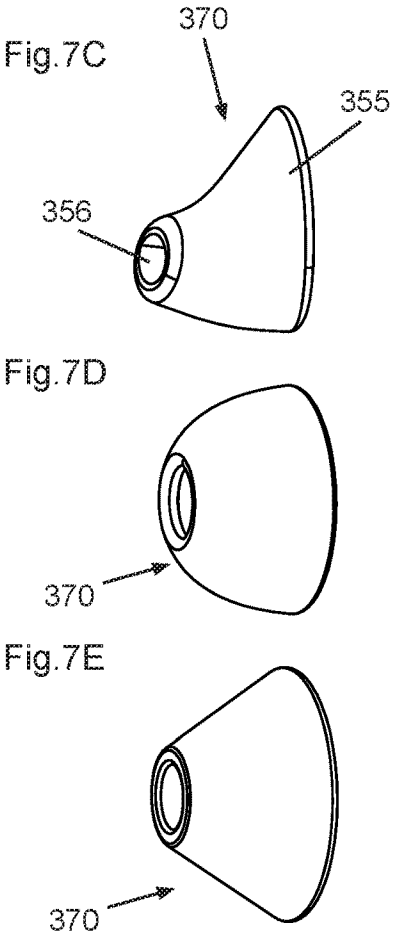
FIGS. 7C, 7D, and 7E show embodiments of eartips.
Figure 7B:
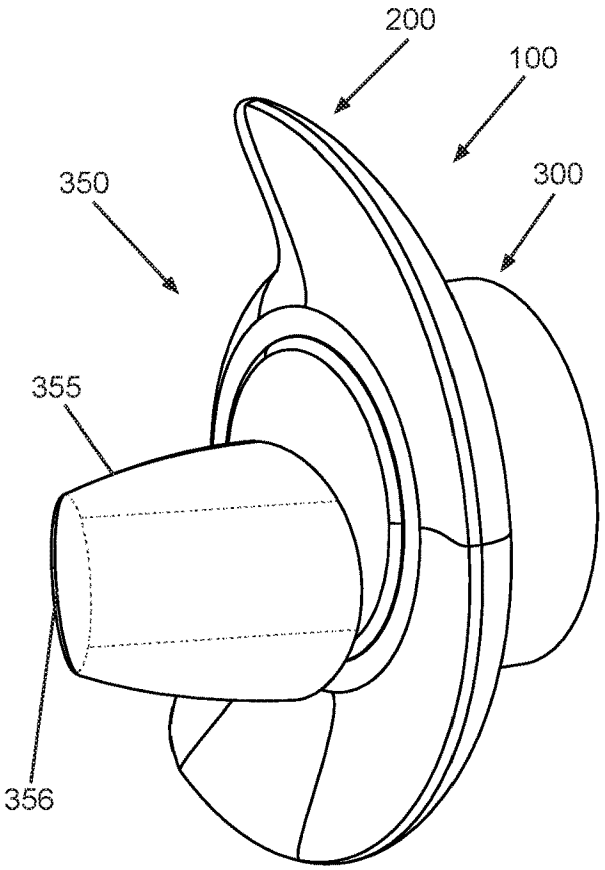
FIGS. 7A and 7B show an ear unit having a skirt and a fixed nozzle 355.
Figure 7A:
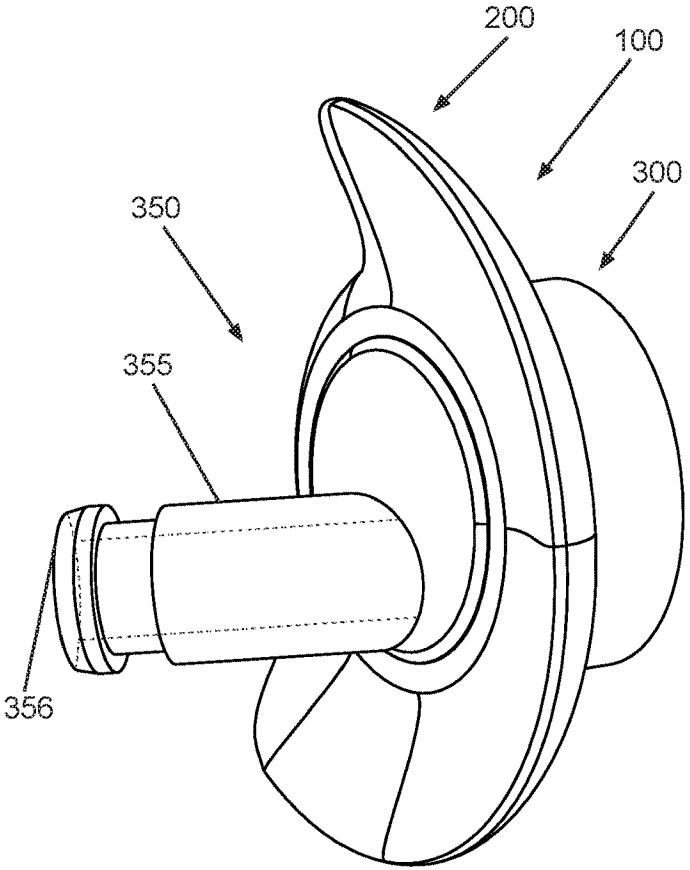

FIG. 7A shows an ear unit having a skirt 200 and a fixed nozzle 355 extending from a housing 300 comprising a hearing element 350. The audio duct opening 356 of the nozzle 355 can be arranged for seating at an entrance to the ear canal and can optionally be provided with a gasket 370 and/or flanges 372 as shown in FIG. 10C, typically using an attachment ring. If at least one of the nozzle, audio duct opening, gasket and flanges make contact with parts of the concha, including the part of the concha that is the entrance to the ear canal, this part can effectively also become a counter pressure member. This can also be freely combined with the counter pressure members discussed earlier, thus reducing the pressure or even eliminate the pressure felt by these nozzle 355 related parts.

FIG. 7B shows a variation of the embodiment of FIG. 7A, with an ear unit having a skirt 200 and a fixed audio duct nozzle 355 extending from a housing 300 comprising a hearing element 350.

The nozzle 355 can be of a fixed length determined during design and adapted for the specific use or intended eartips to be fitted to the nozzle 355 as well as how deep into the opening to the ear canal or the ear canal itself that the design is intended for. In an alternative embodiment the nozzle 355 can be user adaptable.

FIGS. 7C, 7D, and 7E show embodiments of eartips, suited for fitting onto nozzle 355. Preferably these are detachably attached so that the user can select the nozzle that best fits the ear and purpose.

FIG. 7C is a nozzle that is designed to be positioned in a sub tragic region 28 immediately covered by the tragus. It provides a comfortable fit without having to touch the ear canal or the opening to the ear canal. This embodiment can provide some ambient sound into the ear and can be beneficial for mobile phone use.

FIG. 7D is a frustospherical eartip that provides a close fit against the opening of the ear canal, substantially eliminating ambient sound.

FIG. 7E is a frustosconical eartip that provides a close fit against the opening of the ear canal, reducing ambient sound.

Figure 8A:
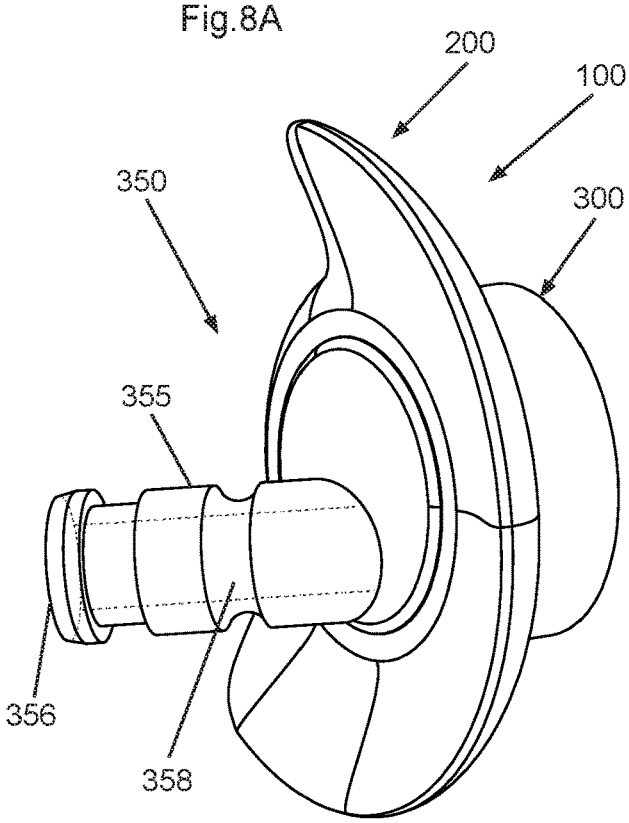
FIGS. 8A and 8B show an ear unit having a skirt and a nozzle 355 connected via a joint.
Figure 8B:
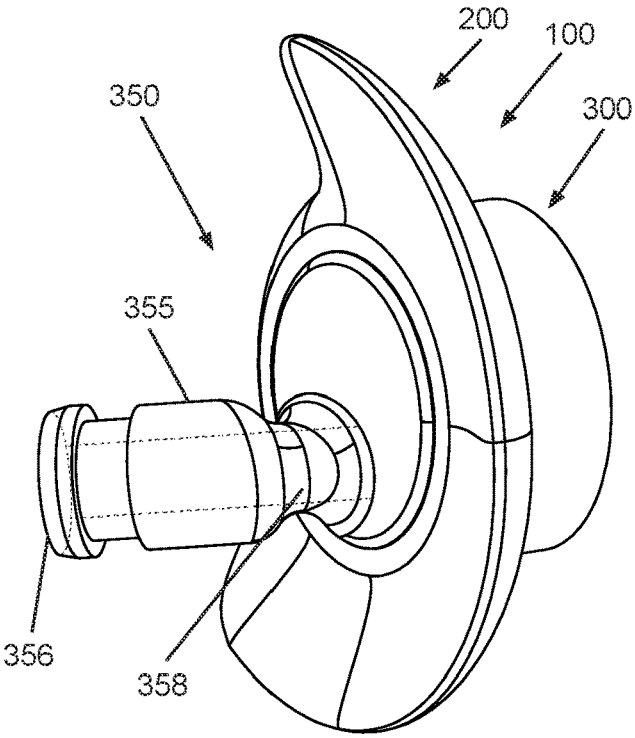

FIGS. 8A and 8B show an ear unit having a skirt and a nozzle 355 connected via a joint 358. The joint 358 can be positioned over a hearing element opening 352 of the housing 300, connecting the hearing element opening to the nozzle 355, allowing a user to freely position the audio duct opening 356 of the audio duct. In FIG. 8A the joint is positioned close to the housing whereas in FIG. 8B the joint is located in a middle part of the nozzle 355. This joint is a constriction in a resilient material for the nozzle 355, allowing the sound to pass through as the joint is bent. The nozzle 355 can be user replaceable so that the user can select the joint that best fits the ear. Also other types of joints can be used such as ball joints.

Alternative Embodiments

A number of variations on the above can be envisaged. For instance the skirt can be split into a plurality of members, each engaging different parts of the antihelix. While two members will work, three members will provide better stability.

Similarly also the collar and the slot can be split into a plurality of parts, again where two members will work and three will be more stable.

It is also possible to have the counter pressure members extending from the skirt or even parts of the housing or nozzle 355.

It is also possible to have counter pressure members 500 that contact the cymba concha or cavum concha. Also the nozzle 355, audio duct opening, the gasket or the flanges extending from the housing could be used as counter pressure members. It is also clear that combinations and a plurality of counter pressure members can be used, for instance to offload the pressure exerted via the nozzle 355 and related parts.

It is also possible to use counter pressure members that engages part of the pinna outside the concha, such as the outer parts of the antihelix, tragus, antitragus and crus of helix, representing an outer boundary of the concha surrounding the concha, rising above the concha floor. This is preferably achieved using a collar or a slot.

Figure 4B:
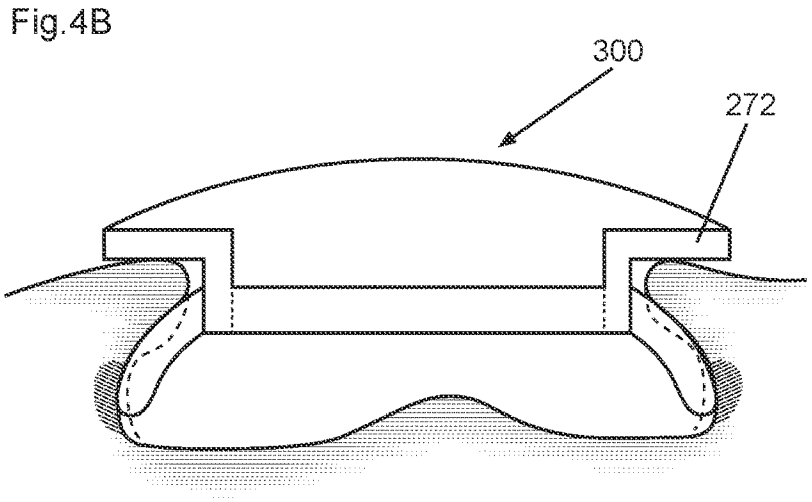
FIG. 4B shows the skirt structure of FIG. 4A inserted into an ear.
Figure 4A:
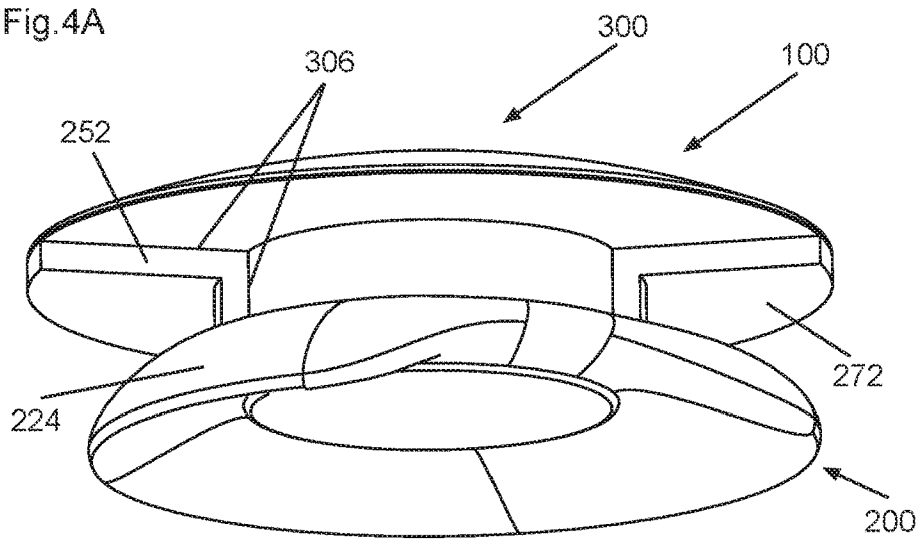
FIG. 4A shows a skirt structure with a collar in a relaxed state with a mushroom shaped housing in the frame.

FIG. 4A shows a skirt structure with a collar 272 in a relaxed state with a mushroom shaped housing in the frame with a retracted hearing element. In this embodiment the collar contacts the outer part of the antihelix 13*b* along an outer antihelix contact area 13*d* and thus provides a counteracting force to the force from the skirt. FIG. 4B shows the skirt structure of FIG. 4A inserted into an ear. Summarised the antihelix 13 is gripped between the skirt 200 and the collar 272.

Preferably the skirt is attached to the housing via a frame. Preferably the collar is also attached to the frame though variations can be envisaged. For instance the collar can be part of the housing itself, in which case the housing and collar can be made as a unitary body. The collar can be made of a resilient material but will also work well using a hard material since one can rely on the skirt for resilience and a comfortable fitting. The distance between the collar and the skirt can be made adjustable, for instance using a screw track in the frame or body so that the collar can be rotated to change distance. Clearly many different techniques for adjusting the distance can be envisaged.

Preferably the collar follows the entire antihelix but also variations are possible, ranging from the entire auricular parts surrounding the concha forming the concha outer boundary to a small finger covering a small part of the concha boundary.

More generalised any contact surface against the pinna outside the concha can be used.

Figure 5B:
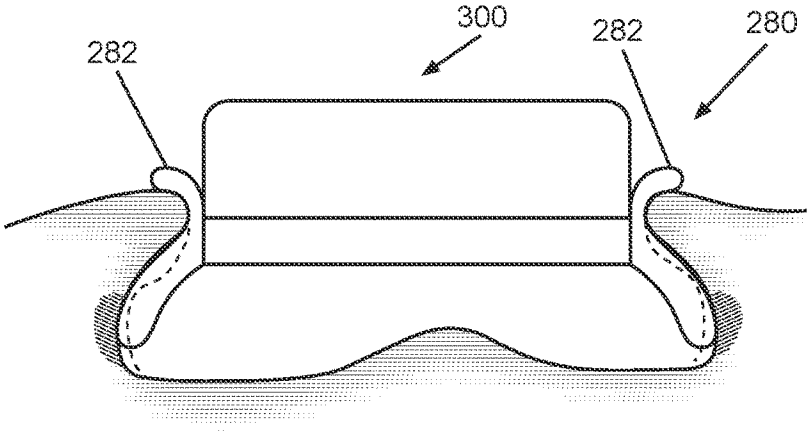
FIG. 5B shows the skirt structure of FIG. 5A inserted into an ear.
Figure 5A:
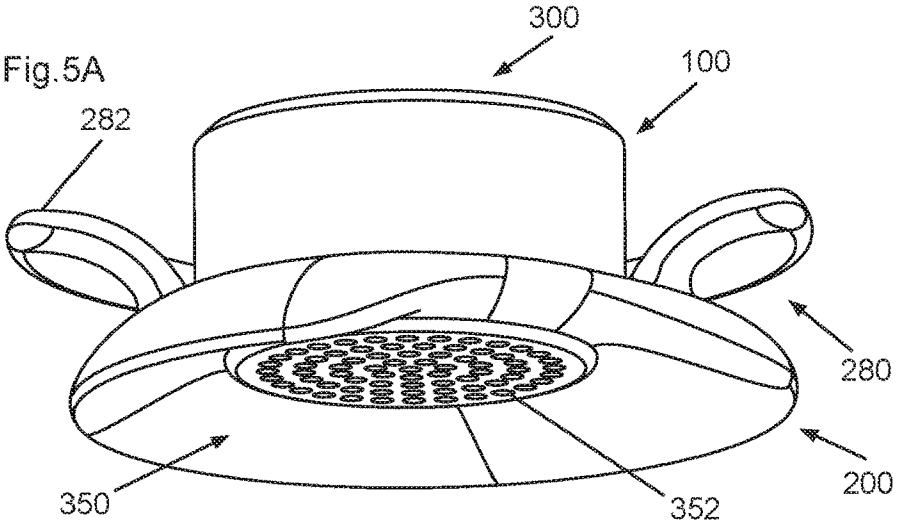
FIG. 5A shows a skirt structure with a slot in a relaxed state with a housing in the frame with a retracted hearing element.

FIG. 5A shows a skirt structure with a slot 280 in a relaxed state with a housing in the frame with a retracted hearing element 350 and hearing element opening 352. In this embodiment the slot surrounds the antihelix, contacting both the inner part of the antihelix 13*a* along an inner antihelix contact area 13*c* as well as the outer part of the antihelix 13*b* along an outer antihelix contact area 13*d* and thus provides a counteracting force to the force from the skirt, thus providing stable positioning in the ear. FIG. 5B shows the skirt structure of FIG. 5A inserted into an ear. In this embodiment the skirt is part of the lower part of the slot and preferably continues to an upper part 282 of the slot, and that the slot provides a closer fit than the collar and skirt embodiment shown in FIGS. 4A and 4B. The technical effect is similar to the embodiment with a collar 272 in that the antihelix 13 is gripped between the surfaces of the slot.

Preferably the slot follows the entire antihelix but also variations are possible, ranging from the entire auricular parts surrounding the concha forming the concha outer boundary to a small finger covering a small part of the concha boundary.

More generalised any contact surface against the pinna outside the concha can be used.

Preferably the skirt is attached to the housing via a frame. Preferably the slot is provided as an extension of the skirt. In this embodiment the skirt and the slot is a unitary structure made of the same material. The resilience of the slot would allow for comfortable adaption of the antihelix.

Figure 7F:
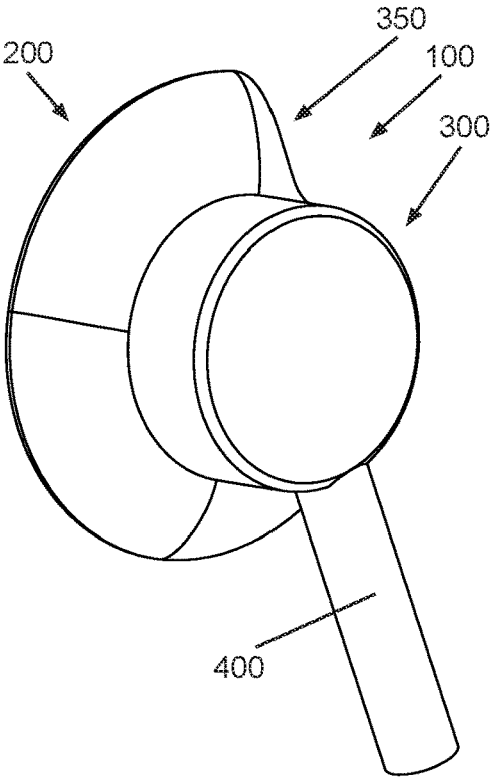
FIG. 7F shows an embodiment with a part extending downward.

FIG. 7F shows an embodiment with a part 400 extending downward. This can be a battery compartment or an interface for a wire for applications using a wire connection to a separate device. Preferably the part 400 extends downwards though the intertragic notch 23, providing further rotational stability in the sagittal plane. This part 400 is suitable for use with an antenna and also microphone, preferably at the end of the part. Together it makes it possible to provide smart and wireless functionalities, and operate on the Internet without external components.

In alternative embodiments the part 400 can extend in other directions, for instance for antenna use the antenna may extend substantially outwards.

Figure 9:
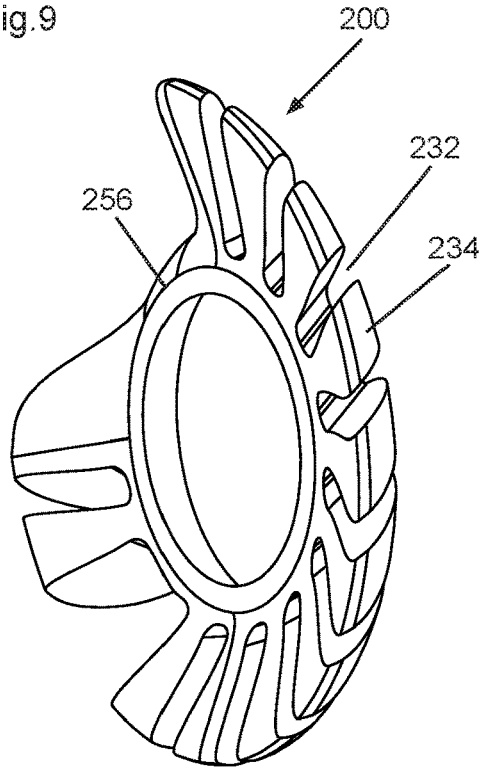
FIG. 9 shows an ear unit having a skirt split into tongues with incisions.

FIG. 9 shows an ear unit having a skirt split into tongues 234 with incisions 232. Thus in some embodiment parts of the skirt can extend under the tragus without touching the antitragus. If the frame skirt interface 256 is flexible the tongues do not have to be flexible. The incisions can separate the tongues in normal configurations, alternatively they can be cut through the skirt obliquely and thus form a pleated skirt that can be collapsed in an overlapping manner.

The use of tongues makes it easy to provide each tongue with varying thickness, width and depth. Also the depth of the incisions can be varied easily.

The use of tongues also make it easy to customise cut outs for passing through components such as audio ducts. Such a cut out is shown in FIG. 9.

Also skirts without tongues and incisions can be provided with varying thickness, width and depth.

Also the skirt can be of one continuous sheet of material folded over and pleated in a more traditional manner. For this disclosure the term pleated is used for both such an embodiment as well as the above embodiment with incisions.

FIG. 10A1 shows an embodiment where the skirt 200, frame 250 and housing 300 are effectively one single unitary body. The purpose of the frame is to allow adaption of an expensive housing to one of several less expensive skirts. In some cases such as where the housing itself is not expensive it would be more economical to dispense with the frame and provide the skirt onto the housing in a unitary body.

FIG. 10A2 shows a cross section along the line A-A of the embodiment shown in FIG. 10A1.

Preferably this further comprises a nozzle 355 that is also part of the unitary structure. More preferably also an eartip 370 at the end on the audio duct is also part of the unitary structure. This can have many benefits such as providing fewer parts and parts that do not accumulate moisture or dirt in the interfaces.

FIG. 10B shows a variation of the embodiment of FIG. 10A, with an ear unit having a skirt 200 and a fixed nozzle 355 extending from a housing 300 comprising a hearing element 350.

FIG. 10C shows another variation of the embodiment of FIG. 10A, with an ear unit having a skirt 200 and a fixed eartip or gasket 370 surrounding the audio duct opening 356 of the nozzle 355 extending from a housing 300 comprising a hearing element 350. The gasket excludes much of the ambient sounds. In order to further exclude ambient sound the nozzle 355 is provided with a flange 372 between the gasket and the housing. The flange can be combined with further flanges and/or other eartips where it is desirable to exclude ambient sounds.

Gaskets and nozzles can be used to close the opening to the ear canal but alternatively also the ear canal itself.

Figure 11:
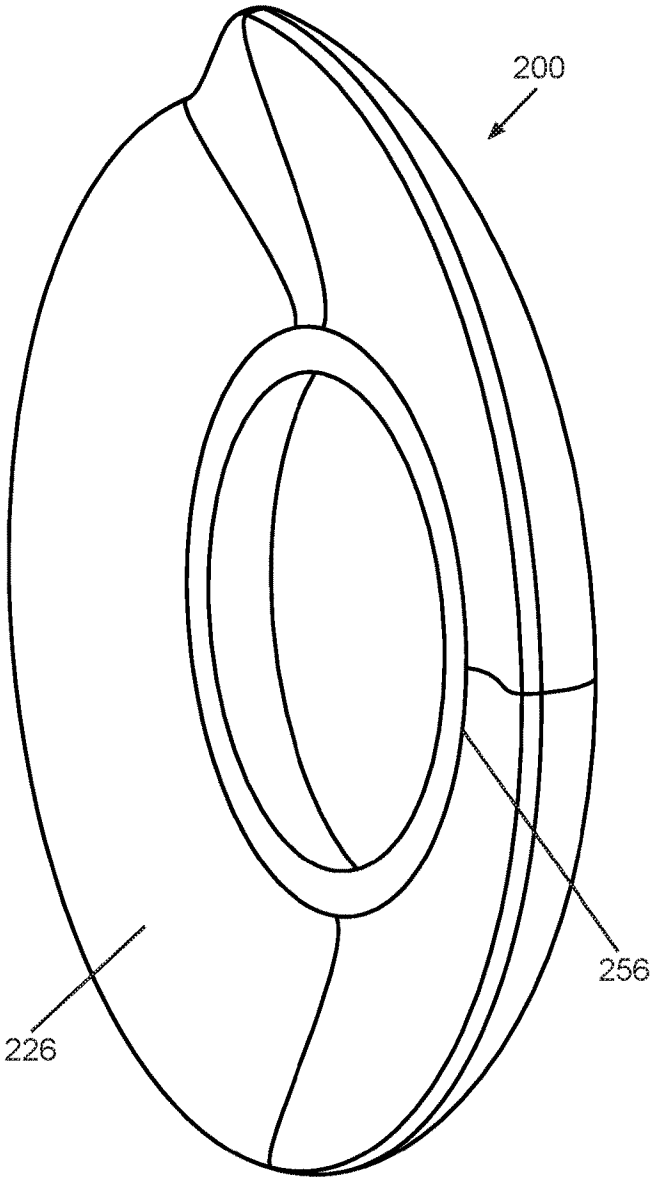
FIG. 11 shows an ear unit having a full circle skirt covering substantially the entire concha.

FIG. 11 shows an ear unit having a full circle skirt covering substantially the entire concha. The skirt starts from an anterior position near the helix, follows under the entire antihelix and continues under the anti tragus, crossing the intertragic notch, and continues under the tragus. From a position under the tragus the skirt rises and reaches the crus of helix. In one embodiment the skirt rises up in a helical manner and covers the crus of helix and continues until it covers the start of the skirt. In this embodiment the part covering the crus of helix is effectively a form of a collar. This part is preferably made of a resilient material. This embodiment practically closes the concha, also acoustically.

Figure 12A:
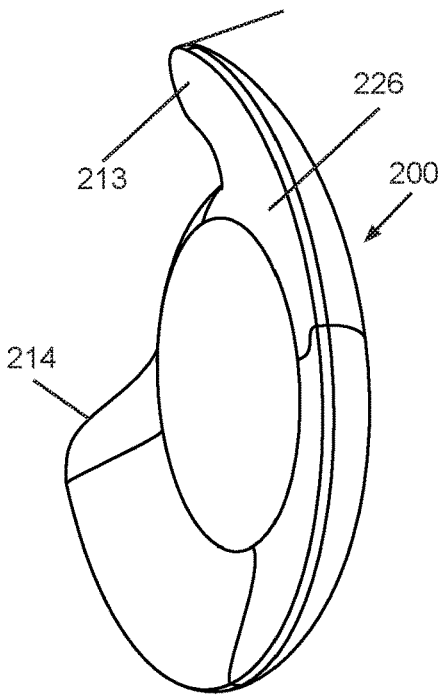
FIGS. 12A and 12B show an unitary ear unit having a skirt with a protrusion and body without a frame.
Figure 12B:
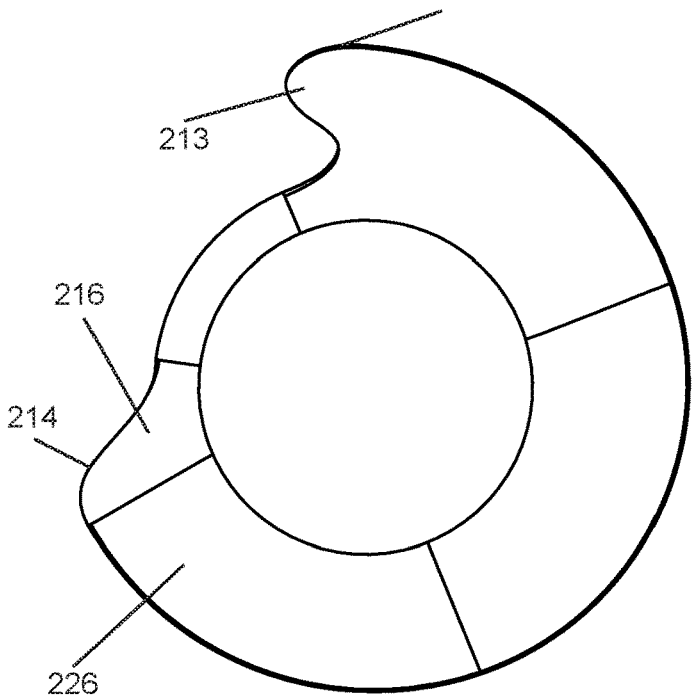

FIGS. 12A and 12B show an unitary ear unit from two different angles, having a skirt with a protrusion 213 and body without a frame. The upper end 212 is provided with a protrusion 213 positioned under the flap 11*a*, and the lower end 214 is positioned at an inferior position of the antihelix and can extend to the antitragus or the tragus.

Figure 13A:
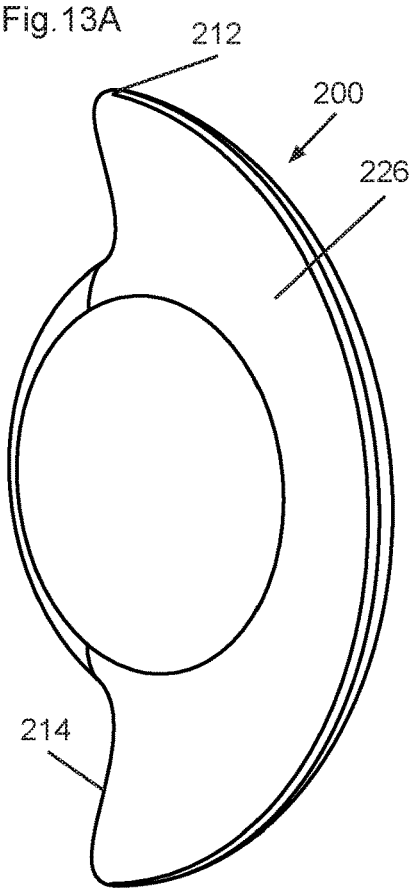
FIGS. 13A and 13B show an ambidextrous ear unit having a skirt and body without a frame.
Figure 13B:
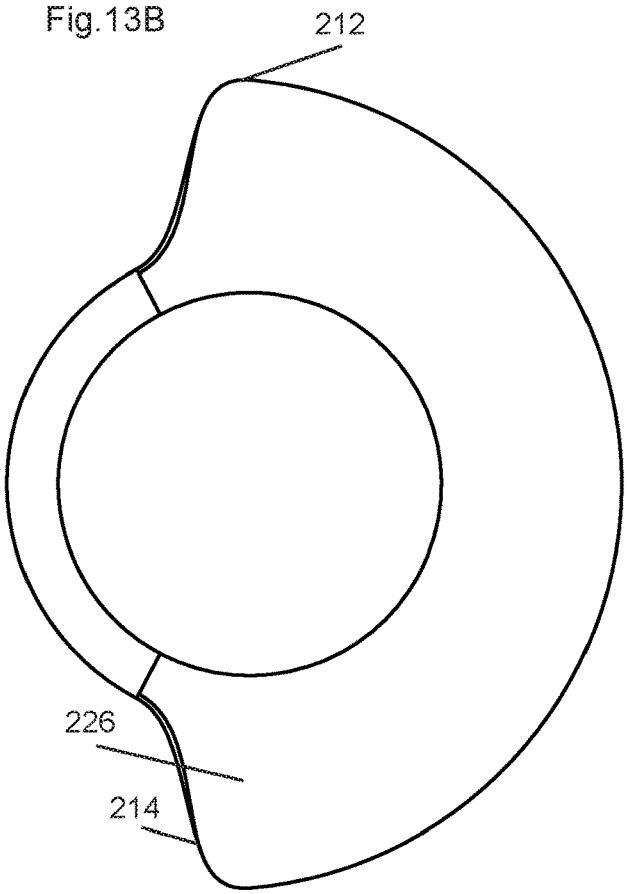

FIGS. 13A and 13B show an ambidextrous ear unit from two different angles, having a skirt and body without a frame. It has been found that the contact area engaged by the skirt is substantially symmetric and this makes it possible to form an ambidextrous skirt for use as an auricular interface. The upper end 212 is positioned at a superior position of the antihelix and the lower end 214 is positioned at an inferior position of the antihelix and can extend to the antitragus or the tragus. The ends 212, 214 are preferably tapered off to provide a comfortable fit. To make this ambidextrous the device is mirror symmetric.

The nozzle 355 can be provided with an extensible part such as a telescoping joint, in order to adapt for differences in how deep into the opening of the ear canal the user wishes to position the audio duct opening. This can be combined with audio duct joints 358.

In most embodiments the electroacoustic element is located in the housing, providing ample room for the acoustic system. In alternative embodiments the electroacoustic element is located at the top of an arm that otherwise appears like the nozzle 355 disclosed earlier. Such an arm can beneficially also be provided with a joint and/or a telescoping joint.

Typically the skirt extends radially from the frame but in alternative embodiments parts of the skirt can extend tangentially or at an angle between tangentially and radially. This can provide a part extending forward, possibly in the form of a protrusion 213, for instance for engaging part under the flap 11*a*. In another embodiment there is a sector cut out so that the frame fits close to the tragus while the skirt tapers off towards the tragus so as to not obstruct the parts close to the opening of the ear canal. Typically the skirt is provided with rounded geometries for improved comfort.

In order to improve the resilient properties of the skirt the skirt can be provided with a hinge 228. This can be a mechanical hinge but is preferably a constricted area that more easily yields to bending forces than the surrounding areas.

FIG. 10A shows an unitary structure with a constriction hinge. The hinge is located close to the to the housing. For structures having a frame the hinge is preferably located close to the frame skirt interface 256. Hinges are particularly beneficial for unitary structures and also skirts provided with tongues.

Some ear units comprise sensors of various kinds, such as physiological parameters such as blood oxygenation and pulse, and sensors that indicate the device is inserted into an ear. It has been found that the present invention lends itself well to such measurements. In some embodiments the skirt uses smart materials such as materials that change resistance when deformed, to detect the device is inserted into an ear. This can be used for the entire skirt or just one or more tongues. This avoids more complex solutions used today such as optical detectors that require optical windows and thus complicates the use of unitary structures. Also the counter pressure members can be used for detectors such as physiological detectors. Since the skirt is compact and allows for a body that does not extend outside the concha the present invention is well suited for sensor systems that are worn continuously for long periods of time as well as when sleeping. The stability of the skirt permits use on non-contact sensors such as infrared sensors for measuring body temperature using the opening to the ear canal.

INDUSTRIAL APPLICABILITY

The invention according to the application finds use in auricular interfaces.

The invention claimed is:

1. An auricular structure, comprising:

a skirt, comprising an outer surface further comprising an outer surface contact area for engaging at least a part of an inner part of an outer boundary of a concha of a pinna, the concha having a concha floor, an inner surface opposite of the outer surface, and an outer skirt edge for pressing against a wall of the concha, wherein the skirt, when in use, is slanted in a direction toward the concha floor, and wherein the skirt does not contact the concha floor when the auricular structure is inserted into an ear.

2. The auricular structure according to claim 1, wherein the outer boundary is at least one from the group comprising antihelix, tragus, antitragus, and crus of helix.

3. The auricular structure according to claim 1, wherein the skirt is pleated.

4. The auricular structure according to claim 1, further comprising a frame for attaching a housing to an auricular interface.

5. The auricular structure according to claim 4, wherein the auricular structure comprises a counter pressure member for contacting parts of the pinna to counter a force caused by the skirt, the counter pressure member being at least one counter pressure member from the group comprising a counter pressure member for engaging a concha wall contact area, a counter pressure member for engaging a crus of helix contact area, a counter pressure member for engaging a cymba concha contact area, and a counter pressure member for engaging a cavum concha contact area of the pinna.

6. The auricular structure according to claim 5, wherein the counter pressure member extends from the frame.

7. The auricular structure according to claim 4, wherein the frame comprises a frame body surrounding a central frame body opening.

8. An auricular structure, comprising:

a skirt, comprising an outer surface further comprising an outer surface contact area for engaging at least a part of an inner part of an outer boundary of a concha of a pinna, the concha having a concha floor, an inner surface opposite of the outer surface, and an outer skirt edge for pressing against a wall of the concha, wherein the skirt does not contact the concha floor when the auricular structure is inserted into an ear;

a frame for attaching a housing to an auricular interface;

wherein the frame comprises a frame skirt interface connecting the skirt to the frame, and wherein the frame skirt interface provides added flexibility to the skirt by comprising a hinge.

9. The auricular structure according to claim 1, wherein an outer surface of the skirt has a concave form.

10. The auricular structure according to claim 1, wherein an outer surface of the skirt has a convex form.

11. The auricular structure according to claim 5, wherein the counter pressure member engages part of the pinna outside the concha.

12. The auricular structure according to claim 11, wherein the counter pressure member is a collar, and wherein the collar contacts an outer part of an antihelix along an outer antihelix contact area, providing a counteracting force to a force from the skirt.

13. An auricular structure, comprising:

a skirt, comprising an outer surface further comprising an outer surface contact area for engaging at least a part of an inner part of an outer boundary of a concha of a pinna, the concha having a concha floor, an inner surface opposite of the outer surface, and an outer skirt edge for pressing against a wall of the concha, wherein the skirt does not contact the concha floor when the auricular structure is inserted into an ear;

a frame for attaching a housing to an auricular interface;

wherein the auricular structure comprises a counter pressure member for contacting parts of the pinna to counter a force caused by the skirt, the counter pressure member being at least one counter pressure member from the group comprising a counter pressure member for engaging a concha wall contact area, a counter pressure member for engaging a crus of helix contact area, a counter pressure member for engaging a cymba concha contact area, and a counter pressure member for engaging a cavum concha contact area of the pinna;

wherein the counter pressure member engages part of the pinna outside the concha;

wherein the counter pressure member is a slot, and wherein an outer part of the slot contacts an outer part of an antihelix along an outer antihelix contact area, providing a counteracting force to a force from the skirt.

14. The auricular structure according to claim 13, wherein the skirt is part of a lower part of the slot and continues to an upper part of the slot.

15. The auricular structure according to claim 4, wherein the skirt and frame have a unitary structure.

16. The auricular structure according to claim 1, further comprising a housing, wherein the housing is provided with a counter pressure member for engaging at least parts of the concha.

17. The auricular structure according to claim 2, wherein the skirt is pleated.

18. The auricular structure according to claim 2, further comprising a frame for attaching a housing to an auricular interface.

19. The auricular structure according to claim 3, further comprising a frame for attaching a housing to an auricular interface.

20. The auricular structure according to claim 17, further comprising a frame for attaching a housing to an auricular interface.

* * * * *